US006054917A

United States Patent [19]

Asano

[11] Patent Number: 6,054,917

[45] Date of Patent: Apr. 25, 2000

[54] ROTATIVELY DRIVEN TYPE ELECTRIC COMPONENT WITH SLIDER ACTUATED BY SCREW DRIVE

[75] Inventor: Masahiro Asano, Miyagi-ken, Japan

[73] Assignee: Alps Electric Co., Ltd., Tokyo, Japan

[21] Appl. No.: 09/275,719

[22] Filed: Mar. 24, 1999

[30] Foreign Application Priority Data

Mar. 25, 1998 [JP] Japan ..... 10-077013

[51] Int. Cl.[7] ..... H01C 10/40

[52] U.S. Cl. ..... 338/180; 338/118; 338/167; 338/170

[58] Field of Search ..... 338/118, 160, 338/176, 180, 167, 170

[56] References Cited

U.S. PATENT DOCUMENTS

| | | | |
|---|---|---|---|
| 3,414,862 | 12/1968 | Ginsberg | 338/180 |
| 3,694,788 | 9/1972 | Perrisini | 338/180 |
| 3,742,421 | 6/1973 | Van Rooijen | 338/180 |
| 3,846,733 | 11/1974 | Beetle | 338/133 |
| 3,918,023 | 11/1975 | Zdanys | 338/180 |
| 3,938,070 | 2/1976 | Koerner et al. . | |
| 4,365,230 | 12/1982 | Feldman | 338/180 |

*Primary Examiner*—Michael L. Gellner
*Assistant Examiner*—Richard K. Lee
*Attorney, Agent, or Firm*—Brinks Hofer Gilson & Lione

[57] ABSTRACT

The present invention relates to a rotatively driven type electric component wherein a slider is moved linearly by rotation of a screw. The rotatively driven type electric component with housings, a drive shaft held by the housings and provided with a screw portion, an insulating substrate held by the housings and having electrically conductive patterns, a slider which comes into sliding contact with the electrically conductive patterns, a movable block which holds the slider, and a plate spring disposed between the movable block and the drive shaft and locked to the movable block, the plate spring having a protuberance, the protuberance of the plate spring being brought into elastic contact with the screw portion of the drive shaft so that the movable block is moved with rotation of the drive shaft.

9 Claims, 5 Drawing Sheets

ROTATIVELY DRIVEN TYPE ELECTRIC COMPONENT WITH SLIDER ACTUATED BY SCREW DRIVE

BACKGROUND OF THE INVENTION

1. Field of the Invention

The present invention relates to a rotatively driven type electric component with a slider actuated by screw drive.

2. Description of the Prior Art

With reference to FIGS. 9 and 10, description will now be directed to a conventional rotatively driven type electric component, which is a variable resistor driven by the rotation of a drive shaft.

FIG. 9 is a front view showing a variable resistor as a conventional rotatively driven type electric component and FIG. 10 is an exploded perspective view showing a movable portion of the variable resistor.

As shown in both figures, a casing 51 has a pair of support blocks 51*a* formed from a molding material and disposed opposite to each other.

A resistance board 52 is formed in the shape of a flat plate using an insulating material, with a resistor (not shown) being formed on the surface thereof, and the substrate 52 is mounted bridgewise between the support blocks 51*a*.

A drive shaft 53 is formed of a metallic material and has been subjected to a cutting work so as to have a screw portion 53*a* for operation and for drive and also have a support portion 53*b*. The drive shaft 53 extends in parallel with the resistance board 52 and is secured to the support blocks 51*a* of the casing 51. An end of the support portion 53*b* extends through one support block 51*a* and is projected to the exterior.

As shown in FIG. 10, the movable block 54 is formed in a generally rectangular shape with use of an electrically insulative material and it has a pair of generally rectangular lugs 60 formed on both side faces thereof, a groove 54*a* formed in an upper surface thereof and a cutout portion 54*b* formed in a lower surface thereof.

A slider 56 is formed in a general U shape by press working with use of a metallic plate having elasticity and has contact portions 57 at nearly central positions. Both end portions of the slider 56 are engaged with the cutout portion 54*b* of the movable block 54. The contact portions 57 of the slider 56 are in elastic contact with the resistor formed on the resistance board 52.

A holder member 55 is formed by bending a linear metallic material having elasticity and comprises a pair of generally U-shaped retaining portions 58 formed at both ends and a rectilinear connecting portion 59 which connects the retaining portions 58 with each other. The paired retaining portions 58 are brought into elastic engagement with the lugs 60 formed respectively on both side faces of the movable block 54 and the connecting portion 59 is fitted between adjacent threads of the screw portion 53*a* of the drive shaft 53 on the upper surface of the movable block 54 to transmit the rotation of the drive shaft 53 to the movable block 54, thereby causing the movable block 54 to move in an axial direction (longitudinal direction) of the drive shaft 53. With this movement of the movable block 54, the contact portions 57 of the slider 56 engaged with the movable block 54 come into sliding contact with an upper surface of the resistor, thus giving rise to an increase (or decrease) of resistance value. Since the retaining portions 58 and the connecting portion 59 are bent in different directions, the holder member 55 is complicated in its structure and hence machining for the holder member becomes complicated.

The following description is now provided about assembling the above rotatively driven type electric component.

First, the drive shaft 53 is mounted between the paired support blocks 51*a* of the casing 51 bridgewise and rotatably. Next, the slider 56 is brought into engagement with the cutout portion 54*b* of the movable block 54. Then, the groove 54*a* of the movable block 54 with the slider 56 locked thereto is brought into engagement with the screw portion 53*a* of the drive shaft 53 by means of a jig (not shown). In this state, the connecting portion 59 of the holder member 55 is fitted between adjacent threads of the screw portion 53*a* from above the mounted drive shaft 53, allowing the retaining portions 58 of the holder member 55 to come into engagement with the lugs 60 of the movable block 54.

Subsequently, the resistance board 52 is fixed to the support blocks 51*a* in parallel with the axis of the drive shaft 53. At this time, the resistance board 52 is mounted so that the resistor on the resistance board 52 is in elastic contactwith the contact portions 57 of the slider 56. Lastly, an upper opening of the casing 51 is closed and a frame (not shown) for holding the resistance board 52 is mounted.

In this way the assembly of the electric component is completed.

In the conventional rotatively driven type electric component, the holder member 55 for driving the movable block 54 is formed by bending a linear metallic material having elasticity and comprises a pair of generally U-shaped retaining portions 58 formed at both ends and a rectilinear connecting portion 59 which connects the retaining portions 58 with each other. The connecting portion 59 of the holder member 55 is fitted between adjacent threads located on the upper side of the screw portion 53*a* of the drive shaft 53, and the shaft is sandwiched between the holder member 55 and the movable block 54. Therefore, when the holder member 55 is to be mounted to the drive shaft 53 and the movable block 54, it is necessary that the drive shaft 53 and the movable block 54 be held simultaneously at predetermined relative positions by use of a jig or the like and holder member 55 then be brought into engagement with the lugs 60 against the resilience thereof. However, this is troublesome.

In addition, since this engagement is made from above the casing 51, it is necessary that an opening be formed in the casing, thus giving rise to the problem that an additional member such as a frame is required to block that opening.

SUMMARY OF THE INVENTION

The present invention has been accomplished for solving the above-mentioned problems and the an object of the invention is to provide a rotatively driven type electric component capable of being assembled easily.

The rotatively driven type electric component according to the present invention comprises a housing, a drive shaft held by the housing and provided with a screw portion, an insulating substrate held by the housing and having electrically conductive patterns, a slider which comes into sliding contact with the electrically conductive patterns, a movable block made of a synthetic resin and which holds the slider on its lower surface side, and a plate spring disposed between the movable block and the drive shaft and retained on an upper surface of the movable block, the plate spring having a protuberance, the protuberance of the plate spring being brought into elastic contact with the screw portion of the drive shaft so that the movable block is moved with rotation of the drive shaft.

In the rotatively driven type electric component according to the present invention, the movable block is provided with one holding portion, with a hole for insertion therein of the drive shaft being formed in the holding portion, and the drive shaft is inserted into the hole of the holding portion.

In the rotatively driven type electric component according to the present invention, the movable block is provided with a pair of opposed holding portions, with holes for insertion therein of the drive shaft being formed in the paired holding portions, and the drive shaft is inserted into the holes of the holding portion.

In the rotatively driven type electric component according to the present invention, the plate spring is retained by the holding portions of the movable block.

In the rotatively driven type electric component according to the present invention, a hole is formed in the movable block and the protuberance of the plate spring and contact portions of the slider are located at positions opposed to the hole.

DETAILED DESCRIPTION OF PREFERRED EMBODIMENTS

Figure 1:
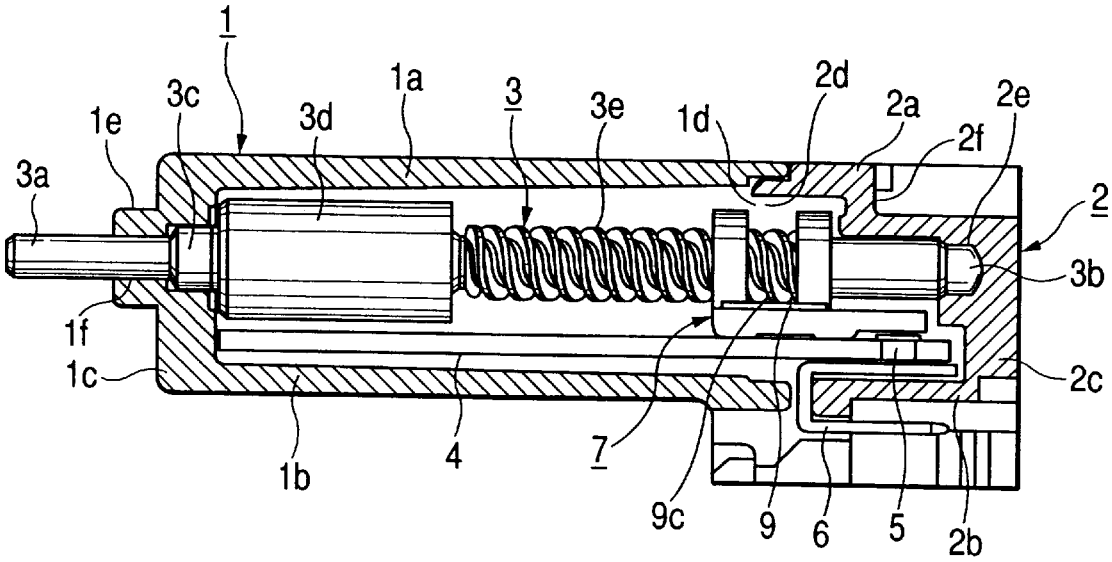
FIG. 1 is a sectional view of a rotatively driven type electric component according to the first embodiment of the present invention.
Figure 2:
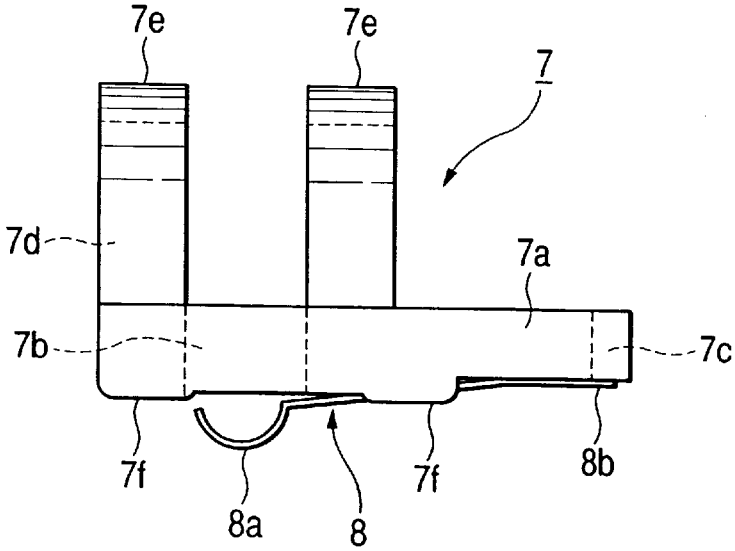
FIG. 2 is a front view showing a movable block with a slider fixed thereto, which is used in the electric component of the first embodiment.
Figure 3:
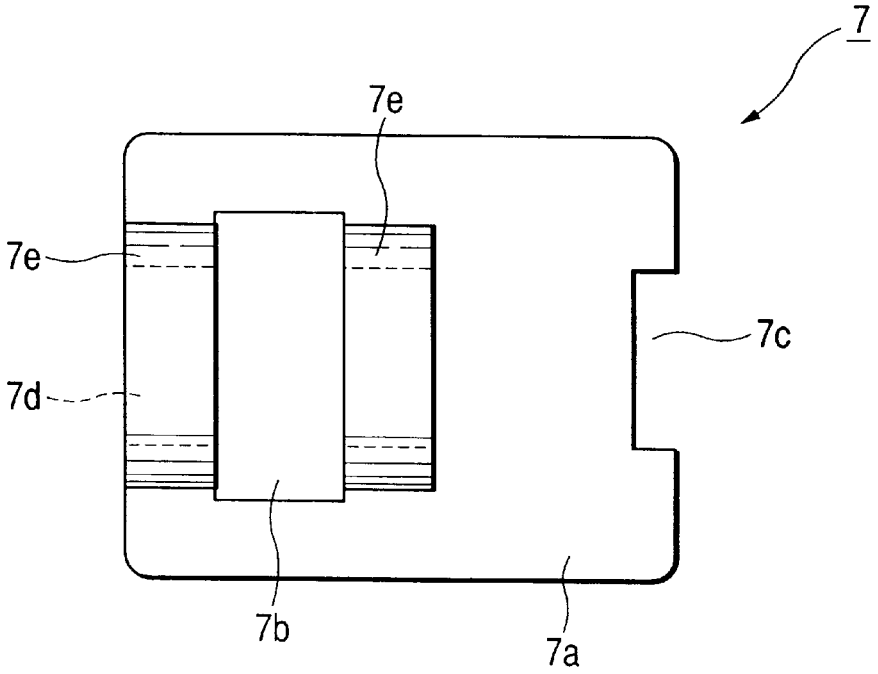
FIG. 3 is a plan view of FIG. 2.
Figure 4:
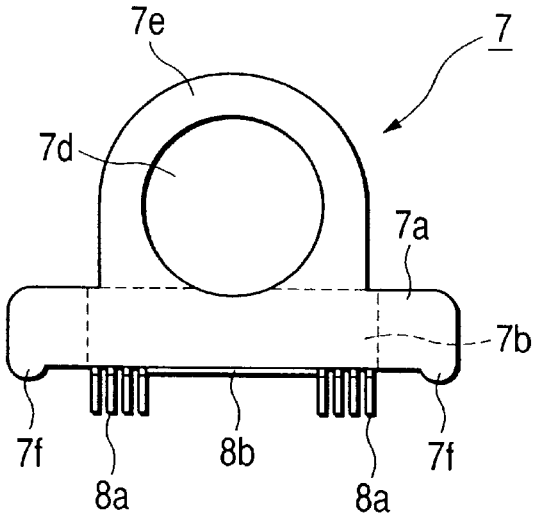
FIG. 4 is a side view of FIG. 2.
Figure 5:
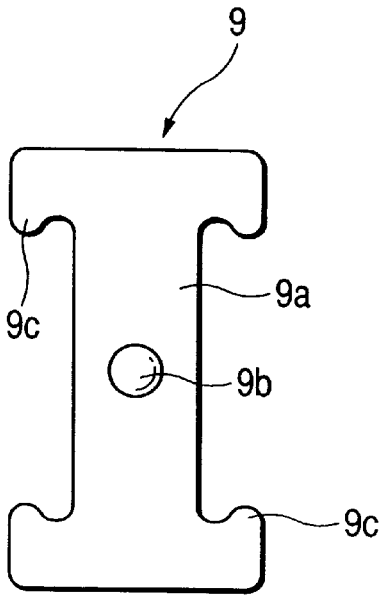
FIG. 5 is a plan view showing a plate spring used in the electric component of the first embodiment.
Figure 6:
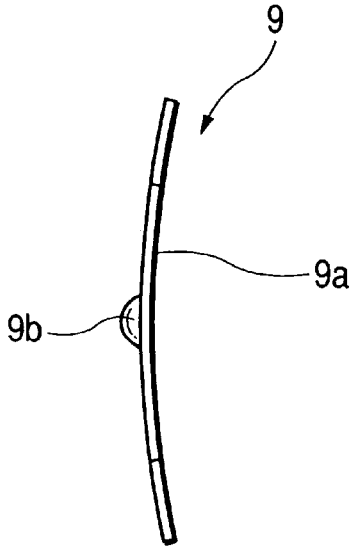
FIG. 6 is a side view of FIG. 5.

Rotatively driven type electric components embodying the present invention will be described hereinafter with reference to the accompanying drawings, in which FIG. 1 is a sectional view of a rotatively driven type electric component according to the first embodiment of the invention, FIG. 2 is a front view of a movable block with a slider fixed thereto, which is used in the electric component, FIG. 3 is a plan view of FIG. 2, FIG. 4 is a side view of FIG. 2, FIG. 5 is a plan view of a plate spring used in the electric component, and FIG. 6 is a side view of FIG. 5.

In the rotatively driven type electric component of the first embodiment, as shown in FIGS. 1 to 6, a first housing 1 is formed by molding an insulative molding material and comprises an upper wall 1*a* and a lower wall 1*b* which are opposed to each other, one side wall 1*c* which provides a connection between the upper and lower walls 1*a*, 1*b* and which extends in the transverse direction, a pair of opposed side walls (not shown) extending in the longitudinal direction, and an open part 1*d* opposed to the side wall 1*c*. The side wall 1*c* is formed with an outwardly projecting convex portion 1*e* and a hole 1*f* of a circular section formed through the convex portion 1*e*, the hole 1*f* comprising a hole of a small diameter and a hole of a medium diameter.

A second housing 2 is formed by molding an insulative molding material and comprises an upper wall 2*a* having a stepped portion 2*f*, a lower wall 2*b* opposed to the upper wall 2*a*, one side wall 2*c* which provides a connection between the upper and lower walls 2*a*, 2*b*, a pair of opposed side walls (not shown), and an open part 2*d* opposed to the side wall 2*c*. A hole 2*e* of a circular section is formed in an inner side of the side wall 2*c*. The first and second housings 1, 2 are disposed so that the respective open parts 1*d* and 2*d* communicate with each other. In this state, both first and second housings are coupled together by a suitable method such as a snap-in method, to constitute a single housing which is substantially sealed hermetically.

A drive shaft 3 is formed, for example, by cutting a metallic material into a generally rod-like shape and comprises cylindrical small-diameter portions 3*a* and 3*b* formed at both ends of the shaft, a cylindrical medium-diameter portion 3*c* which is contiguous to and a little larger in diameter than one small-diameter portion 3*a*, a cylindrical large-diameter portion 3*d* which is contiguous to and a little larger in diameter than the medium-diameter portion 3*c*, and a screw portion 3*e* contiguous to the large-diameter portion 3*d*. The screw portion 3*e* and the other small-diameter portion 3*b* are contiguous to each other. One small-diameter portion 3*a* and medium-diameter portion 3*c* of the drive shaft 3 are formed so as to extend through the hole 1*f* formed in the convex portion 1*e* of the first housing 1, and the tip of the small-diameter portion 3*a* is projected outward from the side wall 1*c*, while the tip of the other small-diameter portion 3*b* is retained in the hole 2*e* formed in the side wall 2*c* of the second housing 2. The large-diameter portion 3*d* and the screw portion 3*e* are housed within the first and second housings 1, 2. Thus, the drive shaft 3 is held rotatably by both housings.

An insulating substrate 4 is formed in the shape of a flat plate using an insulative molding material, and a plurality of electrically conductive patterns are formed on an upper surface of the insulating substrate 4 by printing a resistor ink or the like though not shown. At end portions of the electrically conductive patterns are disposed eyelets 5 in abutment with the electrically conductive patterns. In this connection, a plurality of U-shaped terminals 6 having eyelets 5 are caulked and fixed to the underside of the insulating substrate 4 through the eyelets 5.

The insulating substrate 4 is guided and held by grooves formed in a pair of side walls (not shown) of the housing 1. In this state, the U-shaped terminals 6 are drawn out from the open part 2*d* of the second housing 2 to the exterior of the same housing and their tips are projected toward the side wall 2*c* of the second housing 2 along the outer wall portion of the lower wall 2*b* of the second housing 2. The tips of the terminals 6 constitute male connector portions.

A movable block 7, as shown in FIGS. 2 to 4, is formed by molding an insulating synthetic resin material and it has a generally rectangular substrate portion 7*a* and a pair of parallel holding portions 7*e* opposed to each other and projecting upward from the substrate portion 7*a*.

The substrate portion 7*a* is provided with a rectangular hole 7*b* located at a nearly central part and a rectangular cutout portion 7*c* formed at one end of the substrate portion. The holding portions 7*e* are each formed with a circular hole 7*d* having an axis parallel to the surface of the substrate portion 7*a*.

The paired holding portions 7*e* are opposed to each other on both sides of the rectangular hole 7*b*. On the lower surface of the substrate portion 7*a* is formed a cylindrical convex portion (not shown), and protuberances 7*f* are formed on both sides of the lower surface.

The screw portion 3*e* of the drive shaft 3 is inserted through the holes 7*d* of the paired holding portions 7*e* so that the movable block 7 is engaged with the drive shaft 3 so as to be movable in the axial direction of the drive shaft.

A slider 8 is formed by punching and bending a metallic plate having elasticity such as a phosphor bronze plate and it has a plurality of generally semicircular contact portions 8*a* formed at one end of the slider and a holding portion 8*b* provided at the opposite end of the slider to hold the contact portions 8*a*. A circular hole (not shown) is formed nearly centrally of the holding portion 8*b*. This hole of the holding portion 8*b* is fitted on the convex portion formed on the underside of the substrate portion 7*a* of the movable block 7, followed by caulking, whereby the slider 8 is fixed to the movable block 7. In this fixed state, the contact portions 8*a* of the slider 8 are inpositions opposed to the hole 7*b* formed in the substrate portion 7*a* of the movable block 7. When deflected and pushed upward, the contact portions 8*a* are positioned within the hole 7*b*.

A plate spring 9, as shown in FIGS. 5 and 6, is formed in a generally I shape by punching and bending a metallic plate having elasticity such as a phosphor bronze plate and has a holding portion 9*a*, an upwardly projecting semispherical protuberance 9*b* formed nearly centrally of the holding portion 9*a*, and inwardly projecting semicircular retaining portions 9*c* formed respectively at the four ends of the general I shape. The plate spring 9 is formed so that the whole thereof warps in an arcuate shape, with the protuberance 9*b* being formed at the apex of the arcuate shape. The plate spring 9, with its protuberance 9*b* as an upper surface side, is placed on the substrate portion 7*a* of the movable block 7 so as to cover the hole 7*b* of the substrate portion. In this case, the retaining portions 9*c* of the plate spring 9 are retained so as to bite into the side walls of the retaining portions 7*e*. In this retained state, the upwardly projecting protuberance 9*b* is positioned above the hole 7*b* of the substrate portion 7*a*.

Machining for the plate spring 9 is easy because it is generally in a flat plate shape, as noted previously.

The movable block 7 with the slider 8 and the plate spring 9 thus locked thereto, as mentioned above, can reciprocate in the axial direction of the drive shaft 3 in an inserted state of the screw portion 3*e* of the drive shaft into the holes 7*d* formed respectively in the paired holding portions 7*e* of the movable block 7. In this state, the plate spring 9 engaged with the movable block 7 is located between the movable block and the drive shaft 3 and the protuberance 9*b* thereof is in elastic engagement with a thread root of the screw portion 3*e*, while the protuberances 7*f* are in abutment against the insulating substrate 4, to prevent the movable block 7 from rotating around the drive shaft 3. With the protuberances 7*f*, only the contact portions 8*a* of the slider 8 come into elastic contact with the electrically conductive patterns (not shown) on the insulating substrate 4.

The following description is now provided about assembling the rotatively driven type electric component constructed as above.

First, the insulating substrate 4 with electrically conductive patterns and terminals 6 formed thereon is fitted in guide grooves formed in side walls (not shown) of the first housing 1. Next, the slider 8 is fixed to the lower surface of the substrate portion 7*a* of the movable block 7, and the plate spring 9 is placed on the upper surface of the substrate portion 7*a* in an upwardly projecting state of its protuberance 9*b* and is engaged with the holding portions 7*e*. Then, the screw portion 3*e* of the drive shaft 3 is inserted into the holes 7*d* formed in the holding portions 7*e* of the movable block 7. The drive shaft 3 is thus installed into the movable block 7. At this time, the protuberance 9*b* of the plate spring 9 retained by the movable block 7 is in engagement with a thread root of the screw portion 3*e*.

Next, with the drive shaft 3 inserted into the movable block 7, the small- and medium-diameter portions 3*a*, 3*c* of the drive shaft are inserted into the hole 1*f* formed in the side wall 1*c* of the first housing 1. At this time, the tip of the small-diameter portion 3*a* of the drive shaft 3 is projected outward from the side wall 1*c*.

In this state, the contact portions 8*a* of the slider 8 fixed to the movable block 7 are in elastic contact with the electrically conductive patterns formed on the insulating substrate 4.

Then, the second open part 2*d* of the second housing 2 is overlapped with the open part 1*d* of the first housing 1, whereby both housings are engaged and made integral with each other. At the same time, the small-diameter portion 3*b* of the drive shaft 3 is retained in the hole 2*e* formed in the side wall 2*c* of the second housing 2. Further, the lower wall 2*b* of the second housing 2 is confronted with the U-shaped terminals 6, whereby the insulating substrate 4 with the terminals 6 secured thereto is fixed within the housing.

At this time, the tips of the terminals 6 are located outside the housing. Now, the assembly of the rotatively driven type electric component is completed.

Now, a description will be given of the operation of this electric component.

First, when the small-diameter portion 3*a* of the drive shaft 3 projecting outward from the hole 1*f* formed in the side wall 1*c* of the first housing 1 is turned clockwise for example, the screw portion 3*e* of the drive shaft 3 also turns in the same direction. With this clockwise rotation of the screw portion 3*e*, the protuberances 9*c* of the plate spring 9, which are in engagement with thread roots of the screw portion 34, are moved axially (leftwards in FIG. 1) of the drive shaft 3, with the result that the movable block 7 with the plate spring 9 locked thereto is moved axially of the drive shaft 3 and the contact portions 8*a* of the slider 8 fixed to the movable block 7 slide on the electrically conductive patterns formed on insulating substrate 4. The resistance value, which is outputted from the terminals 6, is increased (or decreased). With this sliding motion of the contact portions 8*a* on the electrically conductive patterns.

As the small-diameter portion 3*a* of the drive shaft 3 is further turned clockwise, the movable block 7 is further moved in the axial direction (leftwards in FIG. 1) and is finally brought into abutment against the large-diameter portion 3*d* of the drive shaft 3, whereby the movement of the movable block is prevented. In this abutted state of the movable block 7 against the large-diameter portion 3*d*, if the small-diameter portion 3*a* is turned clockwise, the protuberances 9*c* of the plate spring 9 locked to the movable block 7 operate so as to get over thread tops of the screw portion 3*e*, whereby the small-diameter portion 3*a* can rotate without movement of the movable block. When getting over the thread tops of the screw portion 3*e*, the protuberances 9*c* of the plate spring 9 are forced down against the resilience of the plate spring and are thereby positioned within the hole 7*b* of the movable block 7. After getting over the thread tops, the protuberances 9*c* again come into engagement with thread roots of the screw portion 3*e*.

Thus, the hole 7*b* of the movable block 7 is formed so as not to obstruct the downward movement of the protuberances 9*c* of the plate spring 9.

In this embodiment, the screw portion 3*e* is of a double-thread structure, so if the small-diameter portion 3*a* of the drive shaft 3 is turned a half turn at most in the counter-clockwise direction, the movable block 7 comes into engagement with screw threads, and with a further rotation of the small-diameter portion 3*a*, the movable block 7 is moved in the direction opposite to the above direction, namely, in the axial direction (rightwards in FIG. 1), then finally the holding portions 7*e* of the movable block 7 are abutted against the stepped portion 2*f* of the upper wall 2*a* of the second housing 2, to make the movable block no longer movable. If the small-diameter portion 3*a* of the drive shaft 3 is further rotated, then in the same manner as above, the protuberances 9*c* of the plate spring 9 are moved so as to get over thread tops of the screw portion 3*e* of the drive shaft 3, so that the movable block 7 is kept unmoving.

Thus, even if the small-diameter portion 3*a* of the drive shaft 3 is rotated beyond the operation range of the movable block 7, there is no fear of the rotatively driven type electric component of this embodiment being broken by excessive rotation of the drive shaft 3 because the protuberances 9*c* of the plate spring 9 engaged with the movable block 7 move vertically so as to get over thread tops of the screw portion 3*e*.

In addition, by changing the dimensional ratio between the large-diameter portion 3*d* and the screw portion 3*e*, it is made possible to cope with various strokes.

Figure 7:
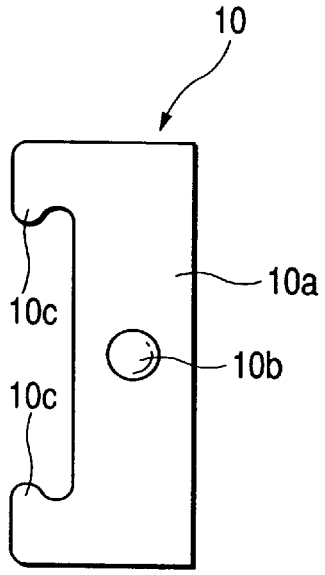
FIG. 7 is a plan view of a plate spring used in a rotatively driven type electric component according to the second embodiment of the present invention.

Reference will now be made to a plate spring used in a rotatively driven type electric component according to the second embodiment of the present invention, which is illustrated in a plan view of FIG. 7.

In the following point the construction of the plate spring in this second embodiment is different from that of the plate spring in the previous first embodiment. The plate spring 9 used in the first embodiment is generally I-shaped as a whole and the semicircular retaining portions (four in all) are formed respectively at the four ends of the I shape, whereas in a plate spring 10 used in this second embodiment, the two retaining portions 9*c* located on the right-hand side of the plate spring 9 in the first embodiment are removed.

The plate spring 10 is formed in a general U shape by punching and bending a metallic plate having elasticity such as a phosphor bronze plate and comprises a holding portion 10*a*, a semispherical protuberance 10*b* formed nearly centrally of the holding portion 10*a*, and semicircular retaining portions 10*c* formed at ends of the holding portion and projecting inwards.

The plate spring 10 is formed in an arcuate shape as a whole, with the protuberance 10*b* being located at the apex of the arcuate shape.

The plate spring 10 is placed on the substrate portion 7*a* in such a manner that the holding portion 10*a* covers the hole 7*b* formed in the substrate portion 7*a* of the movable block 7 and that its retaining portions 10*c* bites into a side wall of one holding portion 7*e*.

Figure 8:
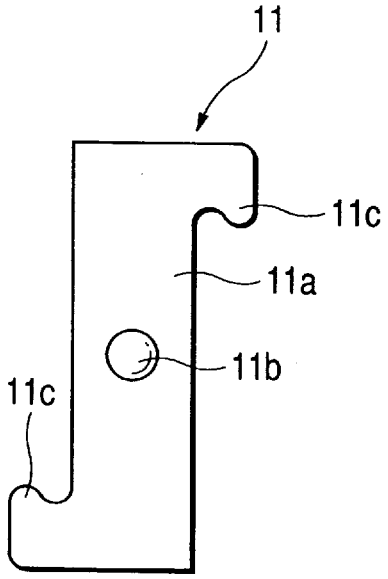
FIG. 8 is a plan view of a plate spring used in a rotatively driven type electric component according to the third embodiment of the present invention.
Figure 9:
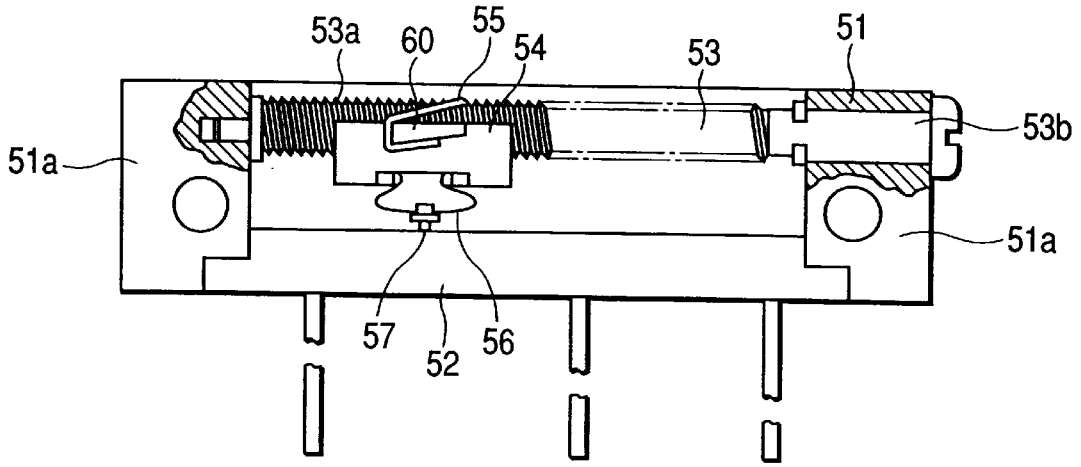
FIG. 9 PRIOR ART
FIG. 9 is a front view of a conventional rotatively driven type electric component.
Figure 10:
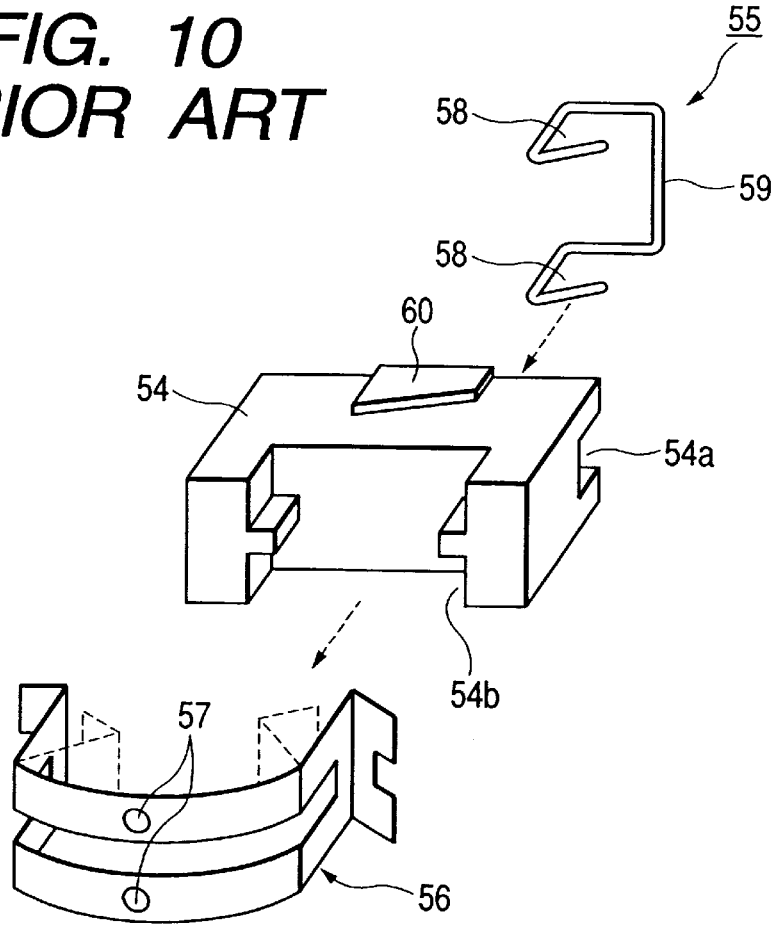
FIG. 10 PRIOR ART
FIG. 10 is an exploded perspective view showing a movable portion in the conventional electric component.

Next, a description will be given below of a plate spring used in a rotatively driven type electric component according to the third embodiment of the present invention, which is illustrated in a plan view of FIG. 8.

In the following point the construction of the plate spring used in this third embodiment is different from that of the plate spring in the previous first embodiment. The plate spring 9 in the first embodiment is generally I-shaped as a whole and the semicircular retaining portions 9*c* (four in all) are formed respectively at the four ends of the I shape, whereas a plate spring 11 used in this third embodiment is generally S-shaped and semicircular retaining portions (two in all) are formed respectively at a pair of end portions of the S shape.

The plate spring 11 is formed by punching and bending a metallic plate having elasticity such as a phosphor bronze plate and it comprises a holding portion 11*a*, a semispherical protuberance 11*b* formed nearly centrally of the holding portion 11*a*, and semicircular retaining portions 11*c* formed at point symmetric positions with respect to the protuberance 11*b* and projecting inwards. The plate spring 11 is formed in an arcuate shape as a whole, with the protuberance 11*b* being located at the apex of the arcuate shape.

Although the movable block 7 used in each of the above embodiments has a pair of parallel holding portions 7*e* opposed to each other, this constitutes no limitation. The movable block 7 may be formed with only one such holding portion.

As set forth above, the rotatively driven type electric component according to the present invention comprises a housing, a drive shaft held by the housing and provided with a screw portion, an insulating substrate held by the housing and having electrically conductive patterns, a slider which comes into sliding contact with the electrically conductive patterns, a movable block which holds the slider, and a plate spring disposed between the movable block and the drive shaft and locked to the movable block, the plate spring having a protuberance, the protuberance of the plate spring being brought into elastic contact with the screw portion of the drive shaft so that the movable block is moved with rotation of the drive shaft. Thus, since the plate spring is disposed between the movable block and the drive shaft, the operation for locking the plate spring to the movable block can be done easily and independently irrespective of the arrangement of the drive shaft.

In the rotatively driven type electric component according to the present invention, the movable block is provided with one holding portion, with a hole for insertion therein of the drive shaft being formed in the holding portion, and the drive shaft is inserted into the hole. Therefore, the movable block and the drive shaft can be rendered integral with each other and this integrally combined movable block and drive shaft can be easily incorporated into the housing.

In the rotatively driven type electric component according to the present invention, the movable block is provided with a pair of opposed holding portions, with holes for insertion therein of the drive shaft being formed in the paired holding portions, and the drive shaft is inserted into the holes. Therefore, the movable block is mounted stably on the drive shaft and can be moved stably by the drive shaft.

In the rotatively driven type electric component according to the present invention, the plate spring is retained by a holding portion of the movable block and thus the holding portion which renders the drive shaft and the movable block integral with each other is also used for retaining the plate spring. Consequently, the number of parts used is reduced.

In the rotatively driven type electric component according to the present invention, a hole is formed in the movable block and the protuberance of the plate spring and contact portions of the slider are located at positions opposed to the hole. Therefore, even if the protuberance of the plate spring and the contact portions of the slider are deflected by the respective elasticities and move toward the hole, both can be positioned within the hole, so it is not necessary to provide any extra space proportional to the amount of such movement, thus permitting reduction in size of the electric component.

What is claimed is:

1. A rotatively driven type electric component comprising:

a housing;

a drive shaft held by said housing rotatable around an axis and provided with a screw portion extending in an axial direction;

an insulating substrate held by said housing and having electrically conductive patterns;

a slider which comes into sliding contact with said electrically conductive patterns;

a movable block made of a synthetic resin and disposed inside said housing so as to hold said slider and movable together with said slider in the axial direction of said drive shaft with said slider in sliding contact with said electrically conductive patterns, said movable block having at least one standing holding portion on a surface facing said drive shaft, said drive shaft being passed through a hole disposed in said holding portion; and a plate spring disposed between said surface of said movable block facing said drive shaft and said drive shaft, having a protuberance disposed between opposing ends and having retaining portions disposed at said opposing ends, said plate spring urging said movable block in a direction such that said slider is positioned into sliding contact with said electrically conductive patterns, said plate spring retained on said movable block by said retaining portions engaged with said holding portion and said protuberance of said plate spring in elastic contact with and in engagement with said screw portion of said drive shaft such that said movable block is moved with rotation of said drive shaft.

2. A rotatively driven type electric component according to claim 1, wherein said movable block is provided with a pair of opposed holding portions, with holes for insertion therein of said drive shaft being formed in said paired holding portions, and the drive shaft is inserted into said holes.

3. A rotatively driven type electric component according to claim 1, wherein said protuberance of said plate spring and contact portions of said slider are disposed on opposing sides of a hole formed in said movable block.

4. A rotatively driven type electric component according to claim 1, wherein said housing comprises:

a first housing of concave cross section including a bottom face, an end of said drive shaft being supported by a portion of said bottom face; and a second housing connected with said first housing and including a face, an opposing end of said drive shaft being supported by a portion of said face.

5. A rotatively driven type electric component according to claim 1, wherein:

said holding portion contains a hole for insertion therein of said drive shaft, the drive shaft being inserted into the hole;

said plate spring is disposed between said holding portion and engaged with said holding portion such that said drive shaft is disposed between said opposing ends of said plate spring, said plate spring extending orthogonal to said axial direction of said drive shaft;

said opposed retaining portions are disposed in directly opposed corners on one side of said plate spring; and said plate spring possesses a "C" shape and is engaged with said holding portion such that said retaining portions clamp onto said holding portion.

6. A rotatively driven type electric component according to claim 2, wherein said plate spring is disposed between said pair of holding portions and engaged with said holding portions such that said drive shaft is disposed between said opposing ends of said plate spring, said plate spring extending orthogonal to said axial direction of said drive shaft.

7. A rotatively driven type electric component according to claim 6, wherein said plate spring has at least one pair of opposed retaining portions at one of said opposing ends and is engaged with said holding portions such that said retaining portions clamp onto said holding portions.

8. A rotatively driven type electric component according to claim 6, wherein said opposed retaining portions are disposed in diagonally opposed corners of said plate spring and said plate spring possesses a "S" shape and is engaged with said holding portions such that said retaining portions clamp onto said holding portions.

9. A rotatively driven type electric component according to claim 7, wherein said plate spring has a pair of opposed retaining portions at each of said opposing ends such that retaining portions are disposed in each corner of said plate spring and said plate spring possesses a "I" shape.

* * * * *